US008882959B2

(12) United States Patent
Malik, Jr. et al.

(10) Patent No.: US 8,882,959 B2
(45) Date of Patent: Nov. 11, 2014

(54) SYSTEM AND METHOD FOR APPLYING TAPE TO A SURFACE

(75) Inventors: Richard S. Malik, Jr., Rossford, OH (US); Thomas Truman, Toledo, OH (US)

(73) Assignee: First Solar, Inc., Perrysburg, OH (US)

( * ) Notice: Subject to any disclaimer, the term of this patent is extended or adjusted under 35 U.S.C. 154(b) by 351 days.

(21) Appl. No.: 13/198,144

(22) Filed: Aug. 4, 2011

(65) Prior Publication Data

US 2012/0037313 A1 Feb. 16, 2012

Related U.S. Application Data

(60) Provisional application No. 61/373,655, filed on Aug. 13, 2010.

(51) Int. Cl.

| | |
|---|---|
| ***B65C 9/25*** | (2006.01) |
| ***C04B 37/00*** | (2006.01) |
| ***B29C 65/00*** | (2006.01) |
| ***B32B 37/00*** | (2006.01) |
| ***B65H 35/00*** | (2006.01) |
| ***B65H 16/00*** | (2006.01) |

(52) U.S. Cl.

CPC ..... *B65H 35/0006* (2013.01); *B65H 16/005* (2013.01); *B65H 35/00* (2013.01); *B65H 35/002* (2013.01); *B65H 16/00* (2013.01); *B65H 2402/441* (2013.01)

USPC ..... 156/325; 156/324; 156/349

(58) Field of Classification Search

USPC ..... 156/324, 325, 433, 349

See application file for complete search history.

(56) References Cited

U.S. PATENT DOCUMENTS

| | | | | |
|---|---|---|---|---|
| 1,774,042 | A | 8/1930 | Stover et al. | |
| 2,449,047 | A | 9/1948 | Anderson | |
| 2,708,076 | A | 5/1955 | Polster et al. | |
| 3,505,153 | A | 4/1970 | Addis | |
| 3,871,940 | A | 3/1975 | Antonioni | |
| 4,151,039 | A | 4/1979 | Lash et al. | |
| 4,288,043 | A * | 9/1981 | Bohnengel | 242/530.2 |
| 4,406,730 | A | 9/1983 | Altmix | |
| 4,777,906 | A | 10/1988 | Mourning et al. | |
| 5,716,492 | A | 2/1998 | Li | |
| 5,736,001 | A | 4/1998 | Samuelson | |
| 6,544,367 | B1 | 4/2003 | Fujimoto et al. | |
| 6,848,490 | B2 | 2/2005 | Ho | |
| 6,974,060 | B2 | 12/2005 | Gomes et al. | |
| 7,069,972 | B1 | 7/2006 | Edelstein | |
| 7,712,507 | B2 | 5/2010 | Huang | |
| 2005/0242225 | A1 | 11/2005 | Robitaille et al. | |
| 2010/0101733 | A1 | 4/2010 | Yu Chen et al. | |
| 2010/0126671 | A1 | 5/2010 | Yu Chen | |

FOREIGN PATENT DOCUMENTS

| | | |
|---|---|---|
| GB | 1 213 316 | 11/1970 |
| JP | 8-217317 | 8/1996 |
| WO | WO 00/56649 A1 | 9/2000 |
| WO | WO 2010/041351 A1 | 4/2010 |

* cited by examiner

*Primary Examiner* — Michael Orlando

(74) *Attorney, Agent, or Firm* — Dickstein Shapiro LLP

(57) ABSTRACT

A tape-dispensing apparatus may include a removable part and a base part.

33 Claims, 4 Drawing Sheets

SYSTEM AND METHOD FOR APPLYING TAPE TO A SURFACE

This application claims priority under 35 U.S.C. §119(e) to Provisional Application No. 61/373,655, filed on Aug. 13, 2010, which is incorporated herein by reference in its entirety.

TECHNICAL FIELD

The present invention relates to photovoltaic modules and methods of manufacturing same.

BACKGROUND

A connection assembly may be electrically connected to a contact region of a photovoltaic module, to facilitate connection between the photovoltaic module and other electrical components, including, for example, one or more additional photovoltaic modules. Tape may be used to secure one or more components of the connection assembly to the photovoltaic module. Current tools and methods for applying tape are inefficient.

DETAILED DESCRIPTION

Figure 1:
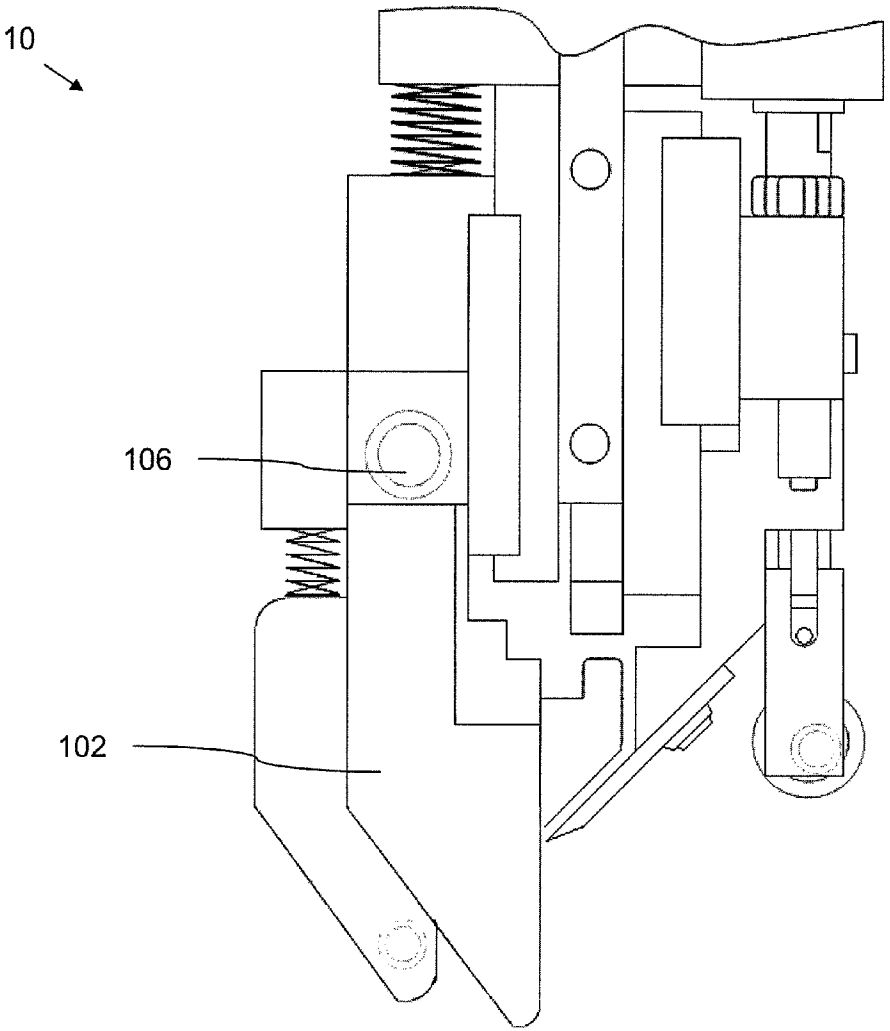
FIG. 1 is a schematic of a tape dispensing apparatus.

Photovoltaic modules can include multiple layers (or coating) created on a substrate (or superstrate). For example, a photovoltaic device can include a barrier layer, a transparent conductive oxide (TCO) layer, a buffer layer, and a semiconductor layer formed in a stack on a substrate. Each layer may in turn include more than one layer or film. For example, the semiconductor layer can include a first film including a semiconductor window layer, such as a cadmium sulfide layer, formed on the buffer layer and a second film including a semiconductor absorber layer, such as a cadmium telluride layer formed on the semiconductor window layer. Additionally, each layer can cover all or a portion of the device and/or all or a portion of the layer or substrate underlying the layer. For example, a "layer" can include any amount of any material that contacts all or a portion of a surface.

A photovoltaic module may include a connection assembly for electrically connecting one or more electrical components to the module, including, for example, one or more additional photovoltaic modules. The assembly may contain various suitable components, including, for example, one or more bussing components or assemblies. For example, one or more conductors may be applied adjacent to a contact layer of a photovoltaic module. The conductors may include any suitable material, including, for example, one or more lead foils. A common or main conductor may be applied adjacent to the one or more conductors. For example, one or more bus bars may be applied adjacent to one or more lead foils. Tape (e.g., double-sided tape) may be used to secure conductive material to the module.

For example, a strip of tape may be applied adjacent to a contact region of a photovoltaic module. The tape strip may be distributed across the length of the module, A conductive lead foil may be applied adjacent to (e.g., directly on) the tape strip. A second tape strip may be applied adjacent to (e.g., directly on) the first tape strip and lead foil, and a second lead foil may be applied thereon. The second tape strip and lead foil may be positioned such that at least a portion of the first lead foil is exposed (i.e., not covered by the second tape strip and lead foil). The first and second lead foils may be positioned such that they do not physically and/or electrically contact one another. Thus the first and second lead foils may be capable of receiving different charges. In other words, the first lead foil may be configured to receive a positive charge, and the second lead foil may be configured to receive a negative charge, or vice versa. The first and second tape strips may contain an adhesive on both sides. Accordingly, the first and second tape strips, respectively, may fixedly secure the first and second lead foils to the module.

One or more common conductors (e.g., bus bars) may be applied adjacent to the tape strips and lead foils, to provide a common connection for the module. The tape strips may also fixedly secure the common conductor to the photovoltaic module. For example, one or more common conductors may be positioned substantially perpendicular to a deposited strip of double-sided tape and/or conductive lead foil. Each of the common conductors may form an electrical connection with any exposed portions of the lead foils. The applied tape may itself be a conductor as well. For example, a strip of conductive tape may be applied adjacent to a contact region of a photovoltaic module. The conductive tape can include a conductive component, such as a foil, metal film, inorganic film or organic film, for example, a conductive polymer. In certain embodiments, the conductive tape can be a foil tape.

The applied tape is thus a critical component for the connection assembly. Proper and expedient application of the tape is needed to ensure proper assembly configuration, as well as efficient production of the modules. Accordingly, the apparatus used to dispense the tape can play a critical role in the manufacturing process. A tape dispensing apparatus may consist of an application "head" including one or more rollers positioned on shafts for supporting and feeding tape through a guide to a designated surface. Existing tape dispensers suffer from several shortcomings. For example, the internal components within the tape dispensing head may be arranged in a compact and rigid configuration, making threading and loading of tape into the apparatus difficult. With some existing designs, the rollers may be partially hidden, further exacerbating the problem. This compact and rigid design also makes the application head difficult to clean between uses. Failure to properly clean the head can result in uneven or distorted application of the tape. Debris within the device may also impact spinning of the rollers, possibly resulting in the inability of the applicator to apply a strip of tape of the full desired length.

It would be desirable to modify existing tape dispenser designs to facilitate threading and loading of tape, as well as cleaning of the internal components within the dispensing head. According to an embodiment of the inventions disclosed herein, a tape dispensing apparatus may include one or more rollers. The one or more rollers may be positioned in a dispensing "head," and may be aligned in any suitable configuration. For example, the one or more rollers may be assembled in a substantially horizontal configuration (i.e., parallel to a module surface). The one or more rollers may include any suitable number of rollers, including, for example, more than two rollers, more than three rollers, less than ten rollers, or less than five rollers. For example, the one or more rollers may include three rollers. The one or more rollers may be configured for holding tape, or for feeding tape to a desired location. For example, the one or more rollers may be configured to feed tape to a guide, which can direct and output the tape to a desired surface. The one or more rollers may be configured to hold tape of any desired design or configuration, and of any desired material, including, for example, any suitable polymer, paper, plastic, cloth, metal, or alloy. The tape may include an adhesive on one or both sides. Any suitable adhesive may be used, including, for example, any suitable organic or plant-based, solvent-type, animal protein-based, or synthetic polymer glue. For example, the adhesive may contain an epoxy resin, epoxy putty, ethylene-vinyl acetate, phenol formaldehyde resin, polyamide, polyester resin, polyethylene, polypropylene, polysulfide, polyurethane, polyvinyl acetate, polyvinyl alcohol, polyvinyl chloride, polyvinyl chloride, polyvinylpyrrolidone, rubber cement, silicone, styrene acrylic copolymer, acrylonitrile, cyanoacrylate, or acrylic.

The rollers may be configured to feed tape for application to a desired area. The rollers may feed the tape through a guide configured to apply the tape in a precise manner to a designated surface. The rollers may be movably secured on shafts, which may be secured inside the head via any suitable securing means, including, for example, any suitable threaded structure, such as a screw, as well as a knob, clip, or latch. The roller may be secured on the shafts by any suitable means. For example, one or more clips may be positioned along each shaft, proximate to (or touching) opposite ends of each roller. The clips may be of any suitable shape. For example, the clips may have a substantially "C" shape. The shafts may have one or more grooves, into which the clips may fit. The clips may be fixedly or movably secured within the grooves. The rollers and roller shafts may be secured within a designated compartment of the apparatus, including, for example, a "head" portion. The head of the apparatus may include a bracket for supporting the shafts and rollers. The bracket may contain any suitable material, including, for example, any suitable metal or alloy, or any suitable plastic material. For example, the bracket may be constructed substantially of aluminum.

To facilitate the threading, loading, and cleaning of the tape dispensing apparatus, the roller shafts may be fixedly secured only within one side of the apparatus, thereby allowing another side of the apparatus to be detached to expose all rollers and shafts inside. For example, an improved tape dispensing apparatus may include one or more roller shafts fixedly secured in the back side of a dispensing head of the apparatus. The roller shafts may be secured by any suitable securing means, including, for example, one or more screws, knobs, pins, or clips. The dispensing head may contain a detachable front side that is movably secured to the rest of the device. The front side may be secured by any suitable means, including, for example, one or more screws, knobs, pins, or clips. The front side may be movably secured, such that the front side may be detached for threading, loading, or cleaning. Although the front side is detachable, it may be sufficiently secured such that the apparatus remains in a closed state during operation thereof. The head also may contain a safety mechanism to further ensure unintentional opening of the apparatus during operation. For example, the tape dispensing head may include a latch to serve as a means for further securing the front side of the head to the rest of the apparatus. The front side may either detach completely, or partially. For example, the front side may be secured by a securing means, upon removal of which, the entire front side may detach from the apparatus. Alternatively, the securing means may merely allow the front side to become movable with respect to the larger apparatus, while still remaining attached in some fashion. For example, the front side may be secured to the rest of the apparatus via a hinge, allowing it to "swing" back and forth when it is in its "detached" position. The back side of the device may be reinforced with a thicker or stronger material than the front side, for providing adequate support for the roller shafts. The thicker or stronger back side material may include any suitable material, including, for example, any suitable metal or alloy. The back side may include one or more parts of varying thicknesses. The back side may provide sufficient structural support for the roller shafts to minimize bending or drooping of the shafts when the front side is in its detached state, such that the rollers are only supported on one end of the shafts.

In one aspect, a tape dispensing apparatus may include a tape dispensing apparatus may include a front section and a back section. The front section may include a base part and a removable part. The tape dispensing apparatus may include one or more rollers positioned in between the front and back sections. The tape dispensing apparatus may include one or more shafts supporting the one or more rollers. Each one of the one or more shafts may orthogonally intersect at least a first side of the back section, and at least a first side of the front section. The tape dispensing apparatus may include a fastener securing the removable part to the base part. The removable part may be positioned such that upon separation of the removable part from the base part, the one or more rollers are exposed.

The tape dispensing apparatus may include one or more fasteners fixedly securing the one or more shafts to the back section. The front or back section may include a metal. The metal may include aluminum. The fastener may include a threaded structure, knob, clip, or latch. The one or more rollers may include two or more rollers. The one or more rollers may include five or less rollers. The one or more rollers may include three rollers. Each one of the one or more rollers may be positioned substantially proximate to one another, and aligned in at least one common plane. The tape dispensing apparatus may include one or more sets of clips. Each one of the one or more sets of clips may movably secure each one of the one or more rollers along a respective shaft. Each one of the one or more sets of clips may include a first clip substantially proximate to a first side of one of the one or more rollers, and a second clip substantially proximate to a second side of one of the one or more rollers. Each one of the one or more shafts may include a first groove for securing the first clip, and a second groove for securing the second clip. The first and second clips may each include a C-shaped clip. The one or more shafts may orthogonally intersect at least a first side of the front section. The one or more shafts may be loosely secured within at least a portion of the front section. The one or more fasteners may orthogonally intersect at least a second side of the back section. The tape dispensing apparatus may include tape distributed around one of the one or more rollers. The tape may include a pressure sensitive adhesive. The tape may include double-sided tape. The tape may include at least one surface containing an adhesive. The adhesive may include a plant-based glue, a solvent-type glue, an animal protein-based glue, or a synthetic polymer-based glue. The tape may include a conductive component. The conductive component may include a metal film, a foil, an organic film, or an inorganic film. The removable part, base part, and the one or more rollers may be configured such that upon separation of the removable part from the base part, the one or more rollers are sufficiently exposed to allow loading of one or more pieces of tape. The removable part, base part, and one or more rollers may be configured such that upon separation of the removable part from the base part, the one or more rollers are sufficiently exposed to allow cleaning of the one or more rollers. The removable part, base part, and one or more rollers may be configured such that upon separation of the removable part from the base part, the one or more shafts are sufficiently exposed to allow cleaning of the one or more shafts. The removable part, base part, and one or more rollers may be configured such that upon separation of the removable part from the base part, the one or more rollers are sufficiently exposed to allow removal of one of the one or more rollers. The removable part, base part, and one or more rollers may be configured such that upon separation of the removable part from the base part, the one or more shafts are sufficiently exposed to allow removal of one of the one or more shafts. The tape dispensing apparatus may include a guide for directing a piece of tape loaded on one of the one or more rollers onto a designated surface. The designated surface may include a contact region of a photovoltaic module. The tape dispensing apparatus may include a tape dispensing head. The one or more rollers, one or more shafts, front and back sections, and fastener may be part of the tape dispensing head.

In one aspect, a method of dispensing tape may include detaching a removable part of a tape dispensing apparatus from a base portion of the tape dispensing apparatus to expose one or more rollers positioned on one or more shafts. One end of each one of the one or more shafts may be secured within the base portion. The method may include loading tape onto at least one of the one or more rollers. The method may include reattaching the removable part to the base portion so that the one or more rollers are no longer exposed. The method may include lowering the tape dispensing apparatus to a surface. The method may include applying at least a portion of the tape to the surface, using the tape dispensing apparatus.

The surface may include a contact region of a photovoltaic module. Applying at least a portion of the tape may include applying double-sided tape. Applying at least a portion of the tape may include applying a pressure sensitive adhesive. Detaching a removable part may include removing a fastener securing the removable part to the base portion. Reattaching the removable part may include securing the removable part to the base portion with a fastener.

Referring to FIG. 1, a tape dispensing apparatus may include a dispensing head 10 housing one or more rollers for dispensing tape. Dispensing head 10 may include any suitable housing material, including, for example, any suitable metal or alloy, as well as any suitable plastic. Dispensing head 10 may include a front side 102 and a back side. The one or more rollers may be positioned on one or more shafts positioned in between front side 102 and the back side. The one or more shafts may orthogonally intersect or contact the front and/or back sides of dispensing head 10. The one or more shafts may be fixedly secured to the back side of dispensing head 10 by one or more fasteners. The one or more fasteners may include any-suitable securing means, including, for example, one or more threaded structures (e.g., a screw), knobs, clips, or latches. The one or more shafts may extend through the front side of dispensing head 10, and may be movably secured therein, such that at least a portion of front side 102 can detach from the dispensing head 10 while leaving the roller shafts in the same position, fixedly secured to the back side of dispensing head 10. When front side 102 is in a detached position, the one or more roller shafts and rollers may be substantially exposed to allow for easy access to those components. In this exposed position, the rollers may be loaded with tape for application to a desired surface. If multiple rollers are present, the rollers may be positioned and sufficiently exposed to allow for threading of one or more pieces of tape between the rollers. The detached position of front side 102 may also allow for cleaning of any of the exposed internal components of dispensing head 10, including, for example, the one or more shafts or rollers. While front side 102 is in the detached state, one or more of the internal components within dispensing head 10 may also be removed, for inspection, repair, replacement, recalibration, or cleaning. It should be noted that the detached state for front side 102 may include complete or partial detachment. For example, front side 102 may be completely detached such that it is no longer a part of the larger apparatus. Alternatively, front side 102 may be partially detached such that it retains some form of physical contact with the larger apparatus. For example, front side 102 may be movably connected to dispensing head 10 via a securing means, such as a hinge, much like a door. In such an embodiment, front side 102 may be opened to become partially detached, and to expose internal components within dispensing head 10. Upon inspection, repair, replacement, recalibration, or cleaning of internal components within dispensing head 10, front side 102 may be reattached, and re-secured with any suitable securing means, including, for example, a threaded fastener, such as a screw.

Front side 102 may be secured to dispensing head 10 via any suitable means, including, for example, fastener 106. Fastener 106 may include any suitable means for fixedly or movably securing front side 102 to dispensing head 10, including, for example, any suitable threaded structure, including, for example, a screw, knob, clip, or latch. Although only fastener 106 is depicted in FIG. 1, it should be noted that the invention is not so limited. Front side 102 may be secured to dispensing head 10 through any additional means. For example, in addition to fastener 106, front side 102 may be further secured to dispensing head via a hinge, which may permit the front side 102 to swing back and forth when fastener 106 is removed or loosened.

Figure 2:
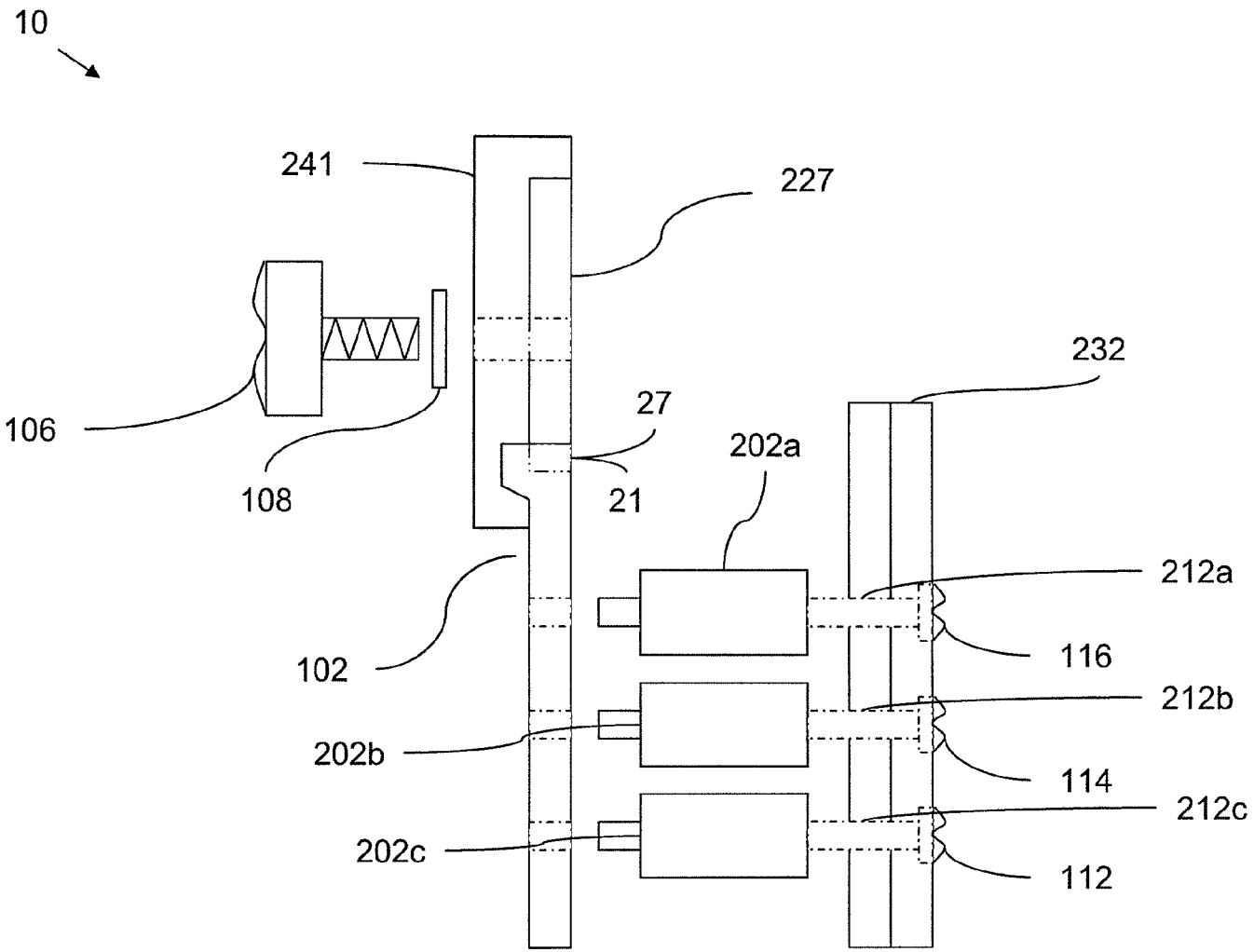
FIG. 2 is a schematic of a tape dispensing apparatus.

FIG. 2 depicts a cross-section view of dispensing head 10, with front side 102 in a detached state. Fastener 106 is shown here removed from its position of securing front side 102 to dispensing head 10, along with washer 108. Also shown is a base portion 227, which remains stationary and connected to the remainder of dispensing head 10. Base portion 227 can be of any suitable size. It can represent a small portion of dispensing head 10, as depicted, or it can be substantially large. In any event, base portion 227 represents the portion of dispensing head 10 that remains in tact after detachment of front side 102. It should be noted that all of front side 102 is not necessarily removed from dispensing head 10. A small or large portion of front side 102 may be removed, so long as sufficient access to the internal components within dispensing head 10 to allow for loading, threading, cleaning, inspection, removal, recalibration, or cleaning thereof is permitted. For example, a small compartment of front side 102 may be detached, either partially or completely, to allow for loading of one or more rolls or strips of tape.

Figure 3:
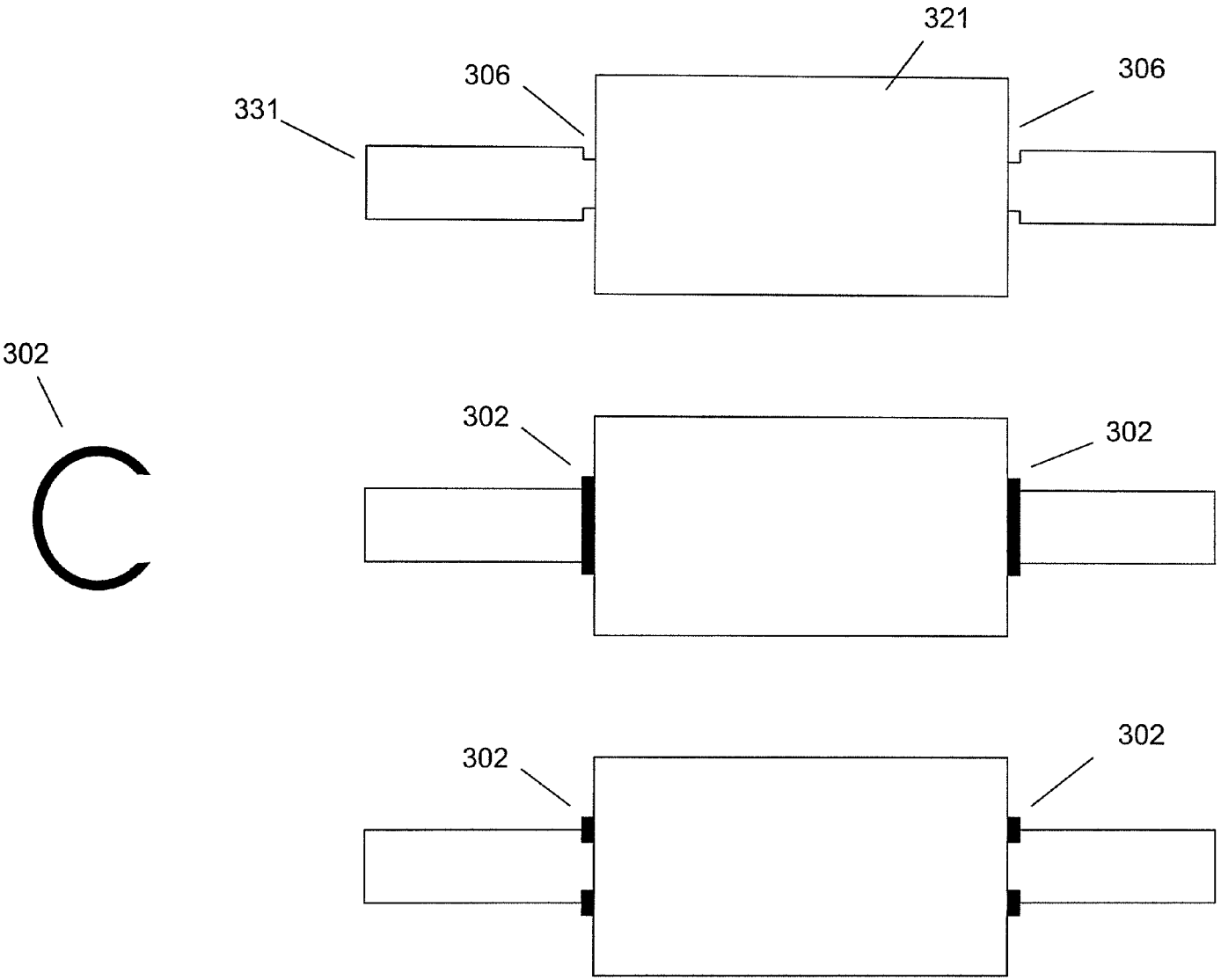
FIG. 3 is a schematic of a roller secured to a shaft using a C-shaped clip.

Also depicted in FIG. 2 are rollers 202*a*-202*c*, which may be movably secured to shafts 212*a*-212*c*, respectively. Rollers 202*a*-202*c* may be secured to shafts 212*a*-212*c* by any suitable means, including, for example, one or more clips. The clips may have any suitable configuration or shape, including, for example, a substantially "C" shape, as depicted in FIG. 3, which depicts an exemplary roller 321, secured to a shaft 331 via clips 302. As shown, each of clips 302 may be positioned along shaft 331, substantially proximate to the ends of roller 321. Shaft 331 may be configured to receive each of clips 302. For example, shaft 331 may contain one or more grooves 306, configured to receive clips 302. Thus a loading sequence for one roller 321 may consist of sliding a first clip 302 over shaft 321 and into a first groove 306. Next, roller 321 may be slid over shaft 331 such that a first end of roller 321 is positioned substantially proximate to the first clip 302, leaving a second groove 306 open. A second clip 302 may be positioned within the open groove 306 to movably secure roller 321 on shaft 331. In its movably secured position, roller 331 may be capable of spinning while maintaining its lateral position on shaft 321 between the clips 302.

Referring back to FIG. 2, each of shafts 212*a*-212*c* may be secured (either fixedly or movably) within dispensing head 10 in between front side 102 and back side 232. Back side 232 may be a part of dispensing head 10, and may be substantially parallel to front side 102. Back side 232 may be part of base part. 227, or vice versa. It should be noted that upon detachment of front side 102 from dispensing head 10, back side 232 remains situated as is. Back side 232 may be configured to receive a portion of any of shafts 212*a*-212*c*. Back side 232 may fixedly secure any of shafts 212*a*-212*c*, such that upon detaching of front side 102 from dispensing head 102, shafts 212*a*-212*c* and roller 202*a*-202*c* situated thereon, may retain a position substantially similar to that which is held when dispensing head 10 is closed. Back side 232 may be constructed of any suitable material for supporting the weight of shafts 212*a*-212*c*, including, for example, any suitable metal or alloy (e.g., aluminum). Shafts 212*a*-212*c* may hold a position substantially parallel to a horizontal plane, and may retain that position after detaching of -front side 102. Back side 232 may be reinforced with a durable material to ensure proper support for shafts 212*a*-212*c*. Shafts 212*a*-212*c* may be secured within back side 232 via any suitable securing means, including, for example, one or more threaded structures, knobs, clips, or latches. For example, shafts 212*a*-212*c* may be secured to back side 232, respectively, by screws 112, 114, and 116. Alternatively, shafts 212*a*-212*c* may be built into back side 232 such that no additional securing means is necessary. In other words, the shafts 212*a*-212 may be protrusions of back side 232, extending laterally from the back side wall.

The unsecured ends of shafts 212*a*-212*c*, i.e., those which are not secured within back side 232, may be secured (fixedly or movably) within front side 102. Although not shown in FIG. 2, a securing means may be included to secure the shafts 212*a*-212*c* to the front side, or the ends can simply rest in a portion of front side 102 configured to maintain the shafts in a movable yet steady position. As noted above, detachment of front side 102 from the rest of dispensing head 10 can be initiated by removal of fastener 106. This can permit partial or complete detachment of all or a portion of front side 102 from dispensing head 10. If only a portion of front side 102 is to detach from dispensing head 10, preferably that portion would include enough of front side 102 (e.g., from just above roller 202*a*, to just below roller 202*c*) to allow sufficient access to all of roller 202*a*-202*c*, shafts 212*a*-212*c*, and any other internal components. Because at least a portion of front side 102 is movable with respect to shafts 212*a*-212*c*, front side 102 can be constructed of a less durable material than back side 232. Front side 102 may also have a smaller thickness than back side 232. Front side 102 may also be composed of portions of varying thicknesses. For example, front side 102 may consist of a "door" portion, configured to swing open to allow access to components situated within dispensing head 10. This door portion of front side 102 may have a smaller thickness than the remainder of front side 102 (e.g., by a factor of about 0.75 or less).

Figure 4:
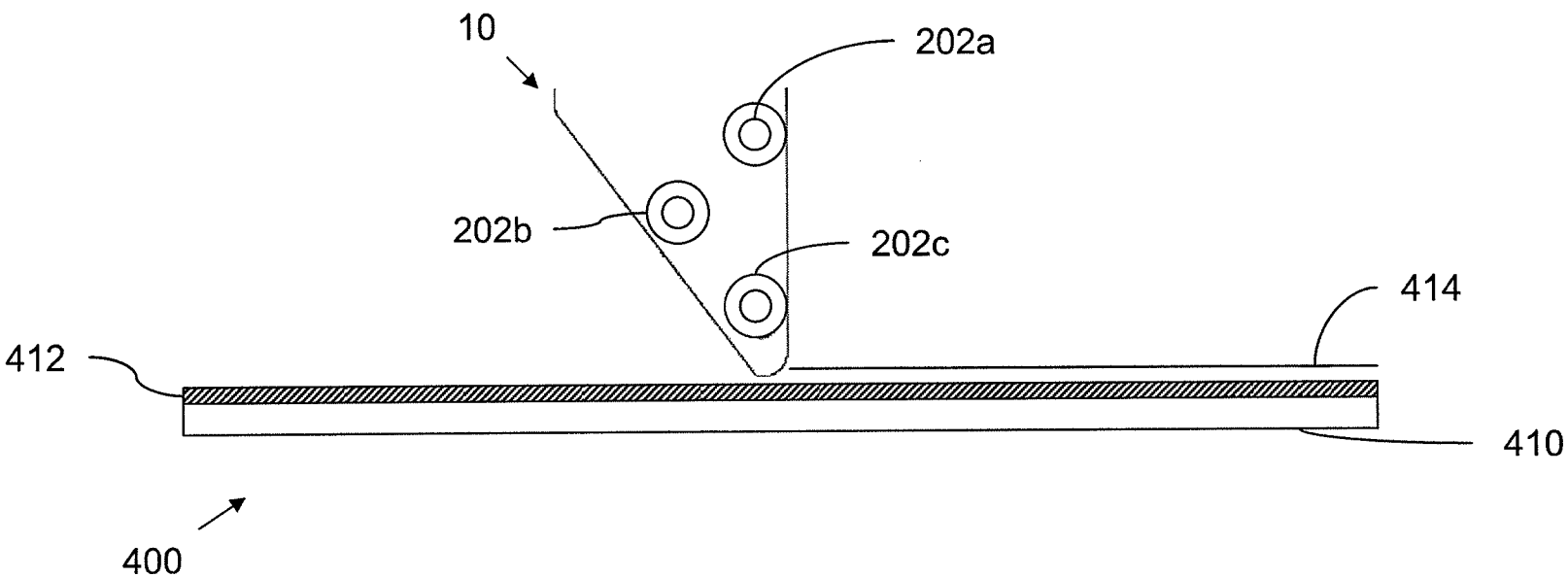
FIG. 4 is a schematic of a tape dispensing apparatus applying tape to a surface of a photovoltaic module.

The tape dispensing head shown in FIGS. 1 and 2 may be used to apply one or more strips of tape to a desired surface. Referring to FIG. 4, by way of example, tape dispensing head 10 (of a larger tape dispensing apparatus) can be positioned substantially proximate to a coated surface of a photovoltaic module 400. Photovoltaic module 400 may contain a substrate 410, which may include any suitable substrate material, including, for example, glass (e.g., soda-lime glass). Substrate 400 may have one or more coating layers 412 deposited thereon. One or more coating layers 412 may contain one or more semiconductor layers and/or contact regions. For example, one or more coating layers 412 may contain a semiconductor window and/or absorber layer. For example, one or more coating layers 412 may include a cadmium telluride layer adjacent to a cadmium sulfide layer. Alternatively, one or more coating layers 412 may contain a layer of cadmium, indium, gallium, and selenium. One or more coating layers 412 may also contain one or more transparent conductive oxide layers (e.g., tin oxide or any other suitable material) configured to convert optical energy into electrical energy. One or more coating layers 412 may also contain a back contact layer, onto which a connection assembly may be applied to facilitate connection of photovoltaic module 400 with one or more electrical components, including, for example, one or more additional photovoltaic modules.

Tape dispensing head 10 may be lowered substantially proximate to photovoltaic module 400 to apply one or more strips of tape 414. Tape 414, can contain any suitable material, including, for example, any suitable polymer, paper, plastic, cloth, metal, or alloy. Tape 414 may include an adhesive on one or both sides. Any suitable adhesive may be used, including, for example, any suitable organic or plant-based, solvent-type, animal protein-based, or synthetic polymer glue. For example, the adhesive may contain epoxy resin, epoxy putty, ethylene-vinyl acetate, phenol formaldehyde resin, polyamide, polyester resin, polyethylene, polypropylene, polysulfide, polyurethane, polyvinyl acetate, polyvinyl alcohol, polyvinyl chloride, polyvinyl chloride, polyvinylpyrrolidone, rubber cement, silicone, styrene acrylic copolymer, acrylonitrile, cyanoacrylate, or an acrylic.

The application of one or more strips of tape 414 onto a contact region of photovoltaic module 400, for example, may facilitate fabrication of a connection assembly on the module. Photovoltaic modules with such an assembly configured thereon may be incorporated into a system for generating electricity. For example, such a module may be illuminated with a beam of light to generate a photocurrent. The photocurrent may be collected and converted from direct current (DC) to alternating current (AC) and distributed to a power grid. Light of any suitable wavelength may be directed at the module to produce the photocurrent, including, for example, more than 400 nm, or less than 700 nm (e.g., ultraviolet light). Photocurrent generated from one photovoltaic module may be combined with photocurrent generated from other photovoltaic modules. For example, the photovoltaic modules may be part of a photovoltaic array, from which the aggregate current may be harnessed and distributed.

Although the inventions discussed herein are discussed in certain aspects with respect to the fabrication of a connection assembly of one or more photovoltaic modules, the inventions are not so limited. For example, the tape dispensing apparatuses and systems disclosed herein may be applicable for any occasion where applying tape to a surface is warranted, including, for example, construction use, home use, or the fabrication of any structures, materials, or devices.

The embodiments described above are offered by way of illustration and example. It should be understood that the examples provided above may be altered in certain respects and still remain within the scope of the claims. It should be appreciated that, while the invention has been described with reference to the above preferred embodiments, other embodiments are within the scope of the claims.

What is claimed is:

1. A tape dispensing apparatus comprising:

a front section comprising a fixed part, the fixed part having a length and width defining a first plane and a removable part, the removable part having a length and width defining a second plane, wherein the first and second planes are substantially parallel;

a back section having a length and width defining a third plane, wherein the third plane is substantially parallel to the first and second planes;

one or more rollers positioned in between the front and back sections;

one or more shafts supporting the one or more rollers, wherein each one of the one or more shafts has an axis substantially orthogonal to the first, second, and third planes and orthogonally intersects at least a first side of the back section, and at least a first side of the front section;

a fastener securing the removable part to the fixed part, wherein the removable part is positioned such that upon separation of the removable part from the fixed part, the one or more rollers are exposed.

2. The tape dispensing apparatus of claim 1, further comprising one or more fasteners fixedly securing the one or more shafts to the back section.

3. The tape dispensing apparatus of claim 1, wherein the front or back section comprises a metal.

4. The tape dispensing apparatus of claim 3, wherein the metal comprises aluminum.

5. The tape dispensing apparatus of claim 1, wherein the fastener comprises a threaded structure, knob, clip, or latch.

6. The tape dispensing apparatus of claim 1, wherein the one or more roller comprises two or more rollers.

7. The tape dispensing apparatus of claim 1, wherein the one or more rollers comprises five or less rollers.

8. The tape dispensing apparatus of claim 1, wherein the one or more rollers comprises three rollers.

9. The tape dispensing apparatus of claim 1, wherein each one of the one or more rollers is positioned substantially proximate to one another, and aligned in at least one common plane.

10. The tape dispensing apparatus of claim 1, further comprising one or more sets of clips, each one of the one or more sets of clips movably securing each one of the one or more rollers along a respective shaft.

11. The tape dispensing apparatus of claim 10, wherein each one of the one or more sets of clips comprises a first dip substantially proximate to a first side of one of the one or more rollers, and a second dip substantially proximate to a second side of one of the one or more rollers.

12. The tape dispensing apparatus of claim 11, wherein each one of the one or more shafts comprises a first groove for securing the first clip, and a second groove for securing the second clip.

13. The tape dispensing apparatus of claim 12, wherein the first and second clips each comprise a C-shaped clip.

14. The tape dispensing apparatus of claim 1, wherein the one or more shafts orthogonally intersects at least a first side of the front section.

15. The tape dispensing apparatus of claim 1, wherein the one or more shafts are loosely secured within at least a portion of the front section.

16. The tape dispensing apparatus of claim 1, wherein the one or more shafts orthogonally intersects at least a second side of the back section.

17. The tape dispensing apparatus of claim 1, further comprising tape distributed around one of the one or more rollers.

18. The tape dispensing apparatus of claim 17, wherein the tape comprises a pressure sensitive adhesive.

19. The tape dispensing apparatus of claim 17, wherein the tape comprises double-sided tape.

20. The tape dispensing apparatus of claim 17, wherein the tape comprises at least one surface containing an adhesive.

21. The tape dispensing apparatus of claim 20, wherein the adhesive comprises a plant-based glue, a solvent-type glue, an animal protein-based glue, or a synthetic polymer based glue.

22. The tape dispensing apparatus of claim 17, wherein the tape comprises a conductive component.

23. The tape dispensing apparatus of claim 22, wherein the conductive component comprises a foil, a metal film, an organic film, or an inorganic film.

24. The tape dispensing apparatus of claim 1, wherein the removable part, fixed part, and the one or more rollers are configured such that upon separation of the removable part from the fixed part, the one or more rollers are sufficiently exposed to allow loading of one or more pieces of tape.

25. The tape dispensing apparatus of claim 1, wherein the removable part, fixed part, and one or more rollers are configured such that upon separation of the removable part from the fixed part, the one or more rollers are sufficiently exposed to allow cleaning of the one or more rollers.

26. The tape dispensing apparatus of claim 1, wherein the removable part, fixed part, and one or more rollers are configured such that upon separation of the removable part from the fixed part, the one or more shafts are sufficiently exposed to allow cleaning of the one or more shafts.

27. The tape dispensing apparatus of claim 1, wherein the removable part, fixed part, and one or more rollers are configured such that upon separation of the removable part from the fixed part, the one or more rollers are sufficiently exposed to allow removal of one of the one or more rollers.

28. The tape dispensing apparatus of claim 1, wherein the removable part, fixed part, and one or more rollers are configured such that upon separation of the removable part from the fixed part, the one or more shafts are sufficiently exposed to allow removal of one of the one or more shafts.

29. The tape dispensing apparatus of claim 1, further comprising a guide for directing a piece of tape loaded on one of the one or more rollers onto a designated surface.

30. The tape dispensing apparatus of claim 29, wherein the designated surface comprises a contact region of a photovoltaic module.

31. The tape dispensing apparatus of claim 1, further comprising a tape dispensing head, wherein the one or more rollers, one or more shafts, front and back sections, and fastener are part of the tape dispensing head.

32. The tape dispensing apparatus of claim 1, further comprising a hinge connecting the removable part to the fixed part, whereby hinge is configured to permanently movably secure the removable part to the fixed part upon separation of the removable part to expose the one or more rollers.

33. The tape dispensing apparatus of claim 1, further comprising a guide configured to direct one or more strips of tape to a coated surface of a photovoltaic module to facilitate fabrication of a connection assembly on the module.

* * * * *